US006056560A

United States Patent [19]

Wu et al.

[11] Patent Number: 6,056,560

[45] Date of Patent: May 2, 2000

[54] HIGH DENSITY PLUG CONNECTOR UNIT

[75] Inventors: Kun-Tsan Wu, Tu-Chen; Waiyin Chou, Chung-Ho, both of Taiwan

[73] Assignee: Hon Hai Precision Ind. Co., Ltd., Taipei Hsien, Taiwan

[21] Appl. No.: 09/090,303

[22] Filed: Jun. 3, 1998

[30] Foreign Application Priority Data

Jun. 5, 1997 [TW] Taiwan ..... 86209403

[51] Int. Cl.[7] ..... H01R 4/66

[52] U.S. Cl. ..... 439/108; 439/607; 439/680; 439/540.1; 439/541.5

[58] Field of Search ..... 439/108, 607, 439/680, 540.1, 609, 541.5

[56] References Cited

U.S. PATENT DOCUMENTS

| | | | |
|---|---|---|---|
| 5,066,240 | 11/1991 | Verdun | 439/607 |
| 5,217,394 | 6/1993 | Ho | 439/541.5 |
| 5,267,876 | 12/1993 | Rupert et al. | 439/541.5 |
| 5,318,463 | 6/1994 | Broschard, III et al. | 439/541.5 |
| 5,417,585 | 5/1995 | Morin et al. | 439/541.5 |
| 5,547,398 | 8/1996 | Ichikawa et al. | 439/607 |
| 5,603,639 | 2/1997 | Lai et al. | 439/607 |
| 5,613,879 | 3/1997 | Fonteneau et al. | 439/607 |
| 5,676,569 | 10/1997 | Davis | 439/540.1 |
| 5,697,799 | 12/1997 | Consoli et al. | 439/607 |
| 5,733,143 | 3/1998 | Ward et al. | 439/541.5 |

*Primary Examiner*—Gary F. Paumen
*Assistant Examiner*—Katrina Davis

[57] ABSTRACT

A plug connector unit includes at least two identical insulative housings each of which retains two rows of contacts in a central wall thereof, wherein a portion of the contacts are defined as ground contacts while the remaining contacts are non-ground contacts, wherein the ground contacts are longer than the non-ground contacts and located at least at distal ends of each row in the central wall of the housing. A metal shielding is used to link the insulative housings as a unit.

11 Claims, 3 Drawing Sheets

HIGH DENSITY PLUG CONNECTOR UNIT

BACKGROUND OF THE INVENTION

1. Field of the Invention

The present invention relates to a high density plug connector unit, especially a plug connector unit having a good shielding structure for suppressing noise from interfering with electrical communication between the connector unit and a mating receptacle connector unit.

2. The Prior Art

Modularizing several connectors into a unit to save space and simplify the number of components has become a trend in the personal computer industry. Therefore, "modularization" is a basic design consideration for connector manufacturers. Noise suppressing considerations based on the present practice of advanced signal communication in a computer or between computers approaches a relatively high frequency spectrum for achieving wide bandwidth and high speed transmission.

SUMMARY OF THE INVENTION

The primary purpose of the present invention is to provide a high density plug connector unit which joins at least two plug connectors by a shielding in order to achieve a modularized structure and which can effectively direct noise to a ground via the shielding.

An alternative purpose of the present invention is to provide a high density plug connector unit within which contacts are specifically separated into shorter contacts and longer contacts, wherein the longer contacts are electrically connected to a ground, so that when a mating receptacle connector unit is inserted into/withdrawn from the plug connector unit, the prompt grounding contact effect between the two units via the longer contacts will effectively diminish noise interference due to prompt engagement/disengagement between the two connector units.

In accordance with one aspect of the present invention, a plug connector unit comprises at least two identical insulative housings each comprising a soldering face and a mating face with a cavity defined therebetween, a central wall projecting upward from an inner surface of the cavity and two rows of passageways respectively defined in opposite side surfaces of the central wall. A plurality of contacts are received in each row of the passageways wherein a portion of the contacts are defined as ground contacts while the other contacts are non-ground contacts, whereby the ground contacts are longer than the non-ground contacts and located at least at distal ends of each row of the passageways. A metal shielding comprises a number of collars corresponding to the number of the insulative housings so that the metal shielding covers the at least two insulative housings while the collars thereof are respectively received and retained in the corresponding cavity of each housing, and the contacts received in each row of the passageways of the central wall are surrounded by a corresponding collar of the metal shielding. When a mating connector unit is engaged with/disengaged from the plug connector unit, a grounding engagement is firstly established and lastly released respective of the other signaling engagements.

DETAILED DESCRIPTION OF THE PREFERRED EMBODIMENTS

Figure 1:
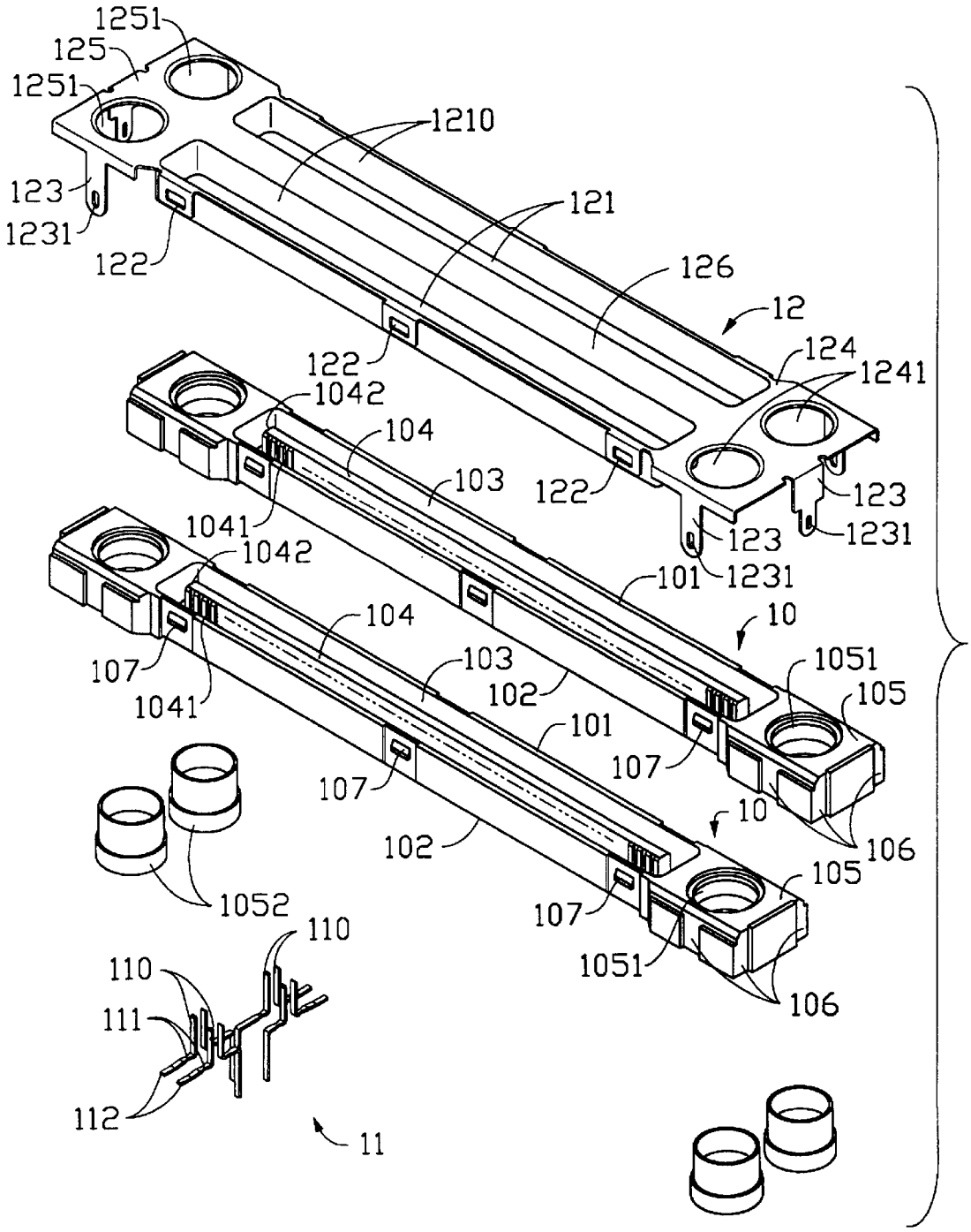
FIG. 1 is an exploded view of a high density plug connector unit in accordance with the present invention.
Figure 2:
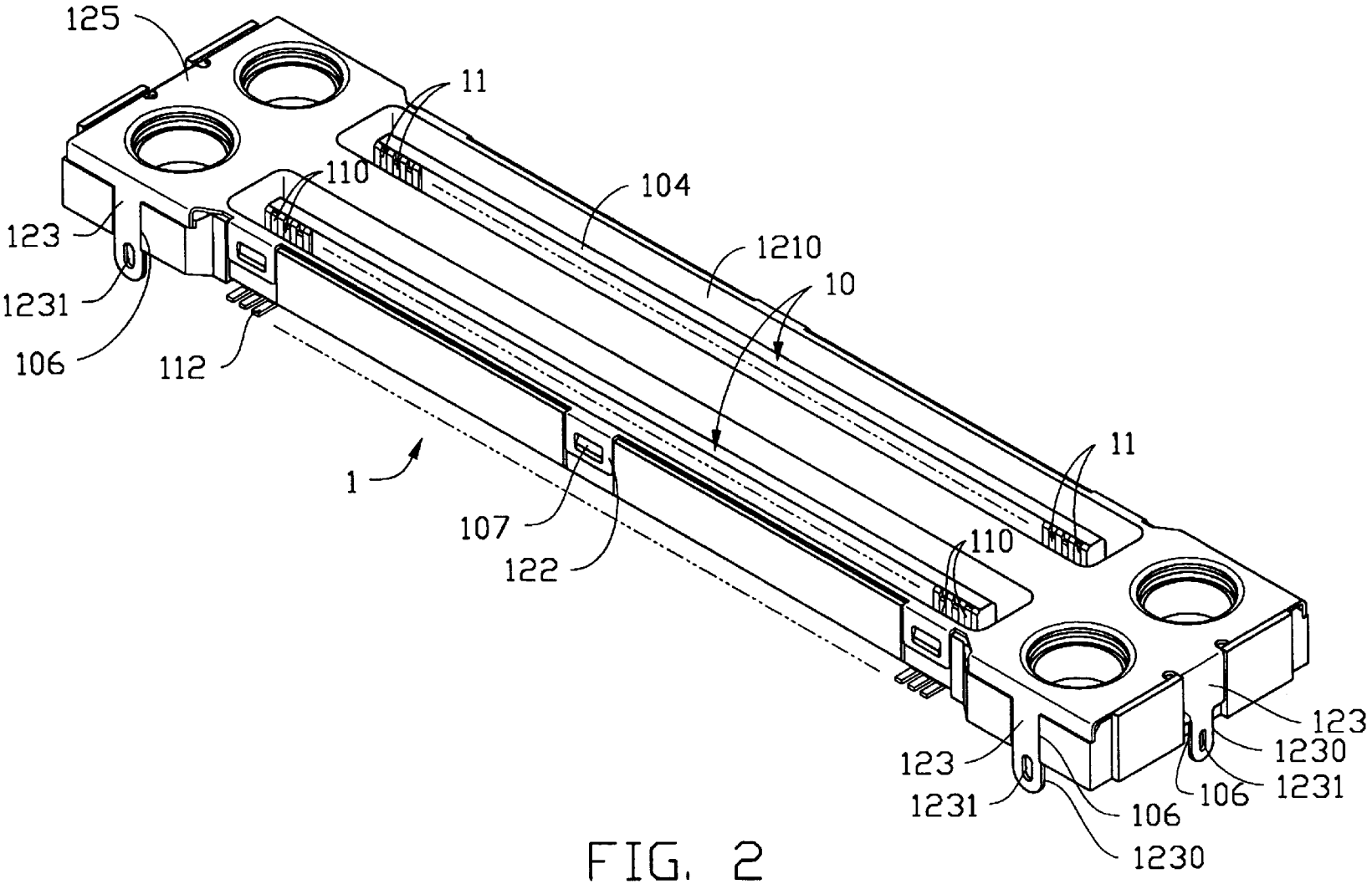
FIG. 2 is an assembled view of FIG. 1.

Referring to FIGS. 1 and 2, a high density plug connector unit 1 in accordance with the present invention comprises two identical insulative housings 10, contacts 11 received in the housings 10, and a shielding 12 made of metal for securing the two housings 10 together. Each housing 10 comprises a mating face 101, a soldering face 102 opposite the mating face 101, and a port or cavity 103 defined between the mating face 101 and the soldering face 102. Three tapered protrusions 107 project from each of the two side walls of the housing 10 for engagement with the shielding 12 which will be further explained later. A central wall 104 projects upward from an inner surface of the cavity 103 and is spaced a distance from outer walls of the housing 10. A plurality of passageways 1041 are defined in two elongate side surfaces of the central wall 104 for receiving and retaining the contacts 11. A cutout 1042 is defined in only one of the two distal ends of the central wall 104 for preventing disorientation of a mating receptacle connector unit (not shown) during engagement with the plug connector unit 1.

Two sockets 105 are integrated with two distal ends of the housing 10 and each socket 105 includes a collar 1051 in a center portion thereof and three reception members 106 respectively formed in three side walls of the socket 105 for engagement with the shielding 12 which will be later explained in detail.

The shielding 12 is made of metal via punching and bending, and comprises two ports or collars 121 each defined by a downward extending peripheral wall 1210 and connected together by an intermediate plate portion 126, three engaging members 122 formed in each side wall of the two collars 121 for securing to the corresponding tapered protrusions 107 of the housings 10, and two side caps 124, 125 respectively connected to two distal ends of the two collars 121 for covering upper surfaces of the sockets 105 of the housings 10. Each of the side caps 124, 125 comprises two collars 1241, 1251 for retention in the collars 1051 of the housings 10. When the shielding 12 is engaged with the two housings 10, each collar 121 is matingly received and retained in the cavity 103 of a corresponding housing 10. Four mating latches 1052 are used to further reinforce the engagement between the collars 1241 of the shielding 121 and the collars 1051 of the housing 10. Three tab members 123 extend downward from each of the side caps 124, 125 for respectively engaging with the corresponding reception member 106 of the housings 10, with an end portion 1230 extending beyond the reception member 106 for soldering to a printed circuit board (not shown). A hole 1231 is defined in the end portion 1230 for facilitating the soldering of the end portion 1230 onto the printed circuit board.

Each contact 11 includes a contacting portion 110 for achieving electrical contact with a corresponding contact of the mating connector unit, an engaging portion 111 integrated with the contacting portion 110 for engagement within the passageway 1041, and a soldering portion integrated with the engaging portion 111 for soldering on a printed circuit board (not shown). In this embodiment, the contacts 11 received in opposite side walls of the central wall 104 are shaped differently. A first row of the contacts 11 received in one side of the central wall 104 have their soldering portions 112 formed laterally for SMT-type soldering while a second row of the contacts 11 received in an opposite side of the central wall 104 have soldering portions 112 formed vertically for through hole type soldering. When the two housings 10 are connected by the shielding 12, the SMT-type contacts 11 are arranged in the outer two rows (only one shown in FIG. 2) while the through hole type contacts 11 are arranged in the inner two rows.

Figure 3B:
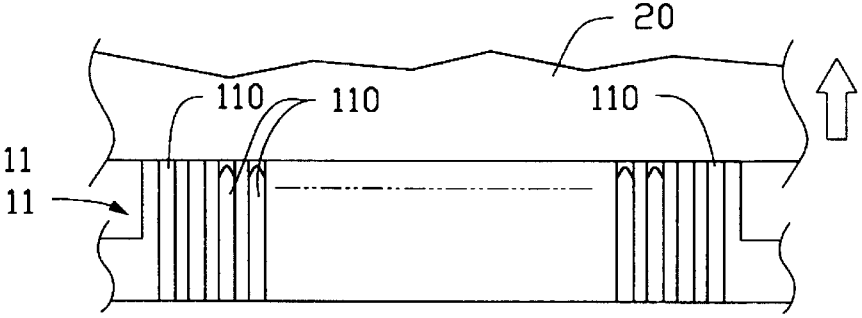
FIG. 3B is a schematic view showing a mating receptacle connector unit being withdrawn from the plug connector unit of the present invention.
Figure 3A:
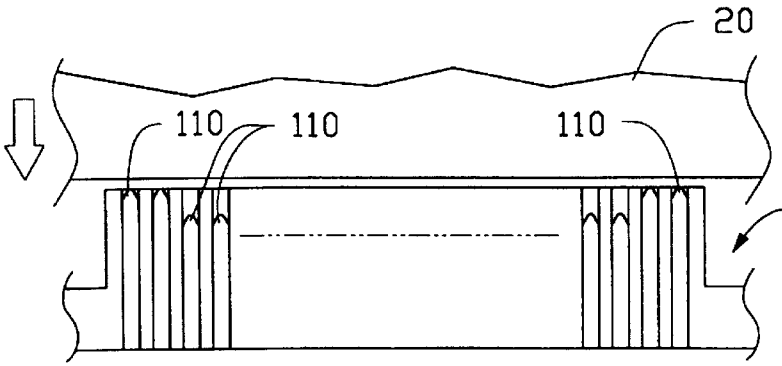
FIG. 3A is a schematic view showing a mating receptacle connector unit being inserted into the plug connector unit of the present invention.

For preventing noise interference during insertion/withdrawal of a mating receptacle connector unit as shown in FIGS. 3A and 3B, the lengths of the contacting portions 110 of the two distal contacts 11 are different from the middle contacts 11. In this embodiment, the two outermost contacts 11 have longer contacting portions 110 than the contacting portions 110 of the middle contacts 110 and all of the longer contacts 11 are connected to a ground of the printed circuit board, i.e., the longer contacts 11 are ground contacts. With this specific arrangement, when a mating connector unit is originally engaged with the plug connector unit 1 of the present invention as shown by the direction of the arrow of FIG. 3A, the two connector units first make grounding contact and then make other signal contacts after the grounding contact, thereby preventing noise interference therebetween. Similarly, when the mating connector unit is disengaged from the plug connector unit 1 of the present invention as shown by the direction of the arrow of FIG. 3B, the two connector units first release signal contacts and then release grounding contact, thereby preventing noise interference therebetween.

While the present invention has been described with reference to a specific embodiment, the description is illustrative of the invention and is not to be construed as limiting the invention. For example, the number of the housings 10 is not limited to two but at least two. The structures of each housings 10 is identical, and the structure of the shielding 12 for linking the housings 10 only requires the same number of collars 121 as the number of housings 10.

Therefore, various modifications to the present invention can be made to the preferred embodiment by those skilled in the art without departing from the true spirit and scope of the invention as defined by the appended claims.

What is claimed is:

1. A plug connector unit comprising:

at least two identical insulative housings each including a soldering face and a mating face, the soldering and the mating face defining a cavity therebetween, each of the at least two identical insulative housings including a central wall projecting upward from an inner surface of the cavity and two rows of passageways respectively defined in opposite side surfaces of the central wall;

a plurality of contacts received in each row of the passageways wherein a portion of the contacts are defined as ground contacts while the remaining contacts are non-ground contacts, wherein the ground contacts are longer than the non-ground contacts and located at least at distal ends of each row of the passageways; and a metal shielding comprising a number of collars corresponding to the number of insulative housings so that the metal shielding covers the at least identical insulative housings so that the metal shielding covers the at least two identical insulative housings while each collar thereof is received and retained in the cavity of the corresponding housing, and the contacts received in each row of the passageways of the central wall are surrounded by a collar of the metal shielding;

whereby when a complementary connector unit is engaged with/disengaged from the plug connector unit, a grounding engagement is firstly established and lastly released respective of other signaling engagements.

2. The plug connector unit as claimed in claim 1, wherein each of the housings comprises two sockets at two distal ends thereof and the metal shielding comprises two side caps for matingly covering the sockets of the housings.

3. The plug connector unit as claimed in claim 2, wherein each of the sockets of the housing has a first collar formed in a center thereof and each side cap of the metal shielding defines a corresponding number of second collars for reception and retention in the first collars of the housings when the metal shielding is mounted to the housings.

4. The plug connector unit as claimed in claim 3 further comprising a plurality of latches for further securing engagement between the first collar of the housing and the second collar of the metal shielding.

5. The plug connector unit as claimed in claim 3, wherein each socket of the housing comprises a plurality of reception members formed on peripheral walls thereof and each side cap of the metal shielding comprises a corresponding plurality of tab members extending downward for engaging with the reception members of the housings, respectively.

6. The plug connector unit as claimed in claim 5, wherein each said housing comprises a plurality of protrusions formed on two opposite side walls and the metal shielding comprises a corresponding plurality of engaging members extending from side walls of the collars for engaging with the protrusions of each said housing, respectively.

7. The plug connector unit as claimed in claim 4, wherein each tab member of the metal shielding has an end portion received in the reception member of the housing for soldering onto a printed circuit board.

8. The plug connector unit as claimed in claim 7 wherein each end portion of the tab member of the metal shielding defines a hole therein for facilitating soldering onto the printed circuit board.

9. A connector assembly comprising:

at least two insulative housings each defining a cavity with a plurality of contacts thereabouts;

a metal shield comprising at least two collars each corresponding to the cavity of each of said housings; and means for securing each of the housings to the shield whereby each of said collars of the shield is received within the corresponding cavity of each of said housings.

10. The connector assembly as defined in claim 9, wherein said means is positioned on both the shield and the housings.

11. The connector assembly as defined in claim 10, wherein said means includes at least one engaging member on the shield and at least one protrusion on each of the housings.

* * * * *